US007685655B1

(12) United States Patent
Delmestri

(10) Patent No.: US 7,685,655 B1
(45) Date of Patent: Mar. 30, 2010

(54) CONVERTIBLE FURNITURE AND METHOD

(76) Inventor: Fabio G. Delmestri, 1416 Wales Dr., High Point, NC (US) 27262

( * ) Notice: Subject to any disclaimer, the term of this patent is extended or adjusted under 35 U.S.C. 154(b) by 97 days.

(21) Appl. No.: 11/432,600

(22) Filed: May 11, 2006

(51) Int. Cl.
*A47C 17/04* (2006.01)

(52) U.S. Cl. ..... 5/39; 5/37.1; 5/18.1

(58) Field of Classification Search ..... 5/37.1, 5/18.1, 17, 55.1, 12.1, 39, 41
See application file for complete search history.

(56) References Cited

U.S. PATENT DOCUMENTS

| | | | | |
|---|---|---|---|---|
| 2,476,062 | A * | 7/1949 | Pierce, Jr. | 70/298 |
| 2,784,766 | A * | 3/1957 | Hale | 297/114 |
| 2,866,207 | A * | 12/1958 | Smilow et al. | 5/18.1 |
| 6,161,231 | A * | 12/2000 | Kraft et al. | 5/18.1 |
| 2002/0175523 | A1 * | 11/2002 | Lu | 292/126 |

OTHER PUBLICATIONS

Healthcare Design Magazine, May 2005 issue.
One page a printout from Brayton International showing a foldable sofa sleeper; undated.

* cited by examiner

*Primary Examiner*—Peter M Cuomo
*Assistant Examiner*—Jonathan J Liu

(57) ABSTRACT

Convertible furniture in the form of a sleeper sofa is demonstrated without the complex mechanical mechanisms conventionally used. The seat is attached to a slide received within a slide support. A seat extension is affixed to the slide support and as the slide is moved forwardly during the method of conversion, for example to convert from sofa mode into the bed mode, the back pivots to lay on the slide support in horizontal alignment with the seat and seat extension thereby forming an extra wide bed. The seat, back and seat extension create a wide sleeping area, wider than that as would be formed by only the seat and back. A latch mechanism positioned behind the front panel secures the slide and slide support in the sofa mode until manually released.

10 Claims, 8 Drawing Sheets

CONVERTIBLE FURNITURE AND METHOD

FIELD OF THE INVENTION

The present invention relates to furniture and a method of conversion whereby a sofa can be easily converted into a wide bed.

DESCRIPTION OF THE PRIOR ART AND OBJECTIVES OF THE INVENTION

In recent years financial pressures have caused many furniture manufacturers to discontinue and redesign their products in order to meet foreign competition and rising labor costs. Convertible sleeper sofas are generally expensive but are furniture items which people like because of the dual functionality. Sleeper sofas are particularly advantageous in small houses and apartments having minimum floor space and number of bedrooms. However, the mechanical mechanism involved in the conversion process which resides below the sofa seat has in some cases become cost prohibitive for certain furniture lines. Also, such mechanisms are often difficult to repair and very expensive to replace. Due to the many moving parts of such standard mechanisms, dust and debris often infiltrate the mechanisms, causing the mechanisms to malfunction and work inefficiently. Conventional sleeper sofas also are usually heavy due in part to the metal mechanisms and are difficult to move once in a house or apartment.

Thus, based on the problems and disadvantages of conventional convertible sleeper sofas the present invention was conceived and one of its objectives is to provide convertible furniture which does not employ a conventional mechanical conversion mechanism.

It is another objective of the present invention to provide convertible furniture which can be manufactured and sold at a relatively low price for easy affordability due to the simplicity of the design.

It is yet another objective of the present invention to provide convertible furniture having a frame with a slide affixed thereto for simple, manual conversion from a sofa to a bed.

It is yet another objective of the present invention to provide a method for converting furniture to form an extra wide bed.

It is yet a further objective of the present invention to provide convertible furniture which can be easily moved and transformed from a sleeper mode to a sofa mode and back by one individual of average or small size.

Various other objectives and advantages of the present invention will become apparent to those skilled in the art as a more detailed description is set forth below.

SUMMARY OF THE INVENTION

The aforesaid and other objectives are realized by providing convertible furniture, preferably in the form of a sofa having a rectangularly shaped metal tubular frame or slide with three (3) L-shaped legs depending therefrom. Each of the L-shaped legs includes a pair of casters for ease in moving and during the conversion process. Slide rails are affixed to the side or arm panels of the furniture to maintain and support the slide when in the sofa mode whereby the slide can be easily pulled forwardly from the slide support when converting from the sofa mode to the bed mode. A seat having a stiff covered plywood bottom is affixed to the slide such as by conventional screws and includes a back pivotally attached thereto. The back is sewn along its lower front edge to the upper rear edge of the seat for pivotable movement. A seat extension also having a covered plywood bottom is provided and affixed to the rear of the slide support likewise by conventional screws. A spring loaded latch positioned at the front panel maintains the furniture in the sofa mode. The conversion method teaches grasping a handle on the front panel and the latch manually released with finger pressure applied to a latch ball to enable moving the slide forwardly. Stops attached to the arm side panels terminate the forward rolling motion of the slide. The back is pivoted into a flat, horizontal position into alignment between the seat and seat extension which is about 25 cm wide to form a relatively wide bed. While the preferred embodiment is shown as a sofa convertible to a bed other types of furniture such as chairs or the like could likewise by made for similar conversion. The arm side panels are affixed to the slide support and rest on the floor to allow the arm side panels to act as anchors during the conversion process as the slide is extended from the slide support by pulling the handle on the front panel. A rear panel is affixed to the arm side panels for added stability and in maintaining the back in an upright posture while in the sofa mode.

The latch mechanism employed includes a finger manipulatable ball which is affixed to a rotatable L-shaped metal angle. The angle is attached to the tubular slide with an axle pin and spring and includes a notch for engaging a lip on the slide support. Thus, when the ball is pushed inwardly the angle is rotated downwardly, extending the spring while pivoting to thereby release the slide support lip from the notch in the angle. By pulling the handle the slide can then be extended forwardly from the slide support with ease due in part to the casters. The handle on the front panel provides ease in pulling the seat and slide forwardly and in manipulating the latch ball. The front panel also provides an opening for a pair of drawers for the storage of items beneath the seat.

The method of converting the sofa to a bed and back into a sofa is relatively easy to learn and does not require the energy for lifting as in heavy, conventional convertible sofas.

DETAILED DESCRIPTION OF THE PREFERRED EMBODIMENTS AND OPERATION OF THE INVENTION

Figure 1:
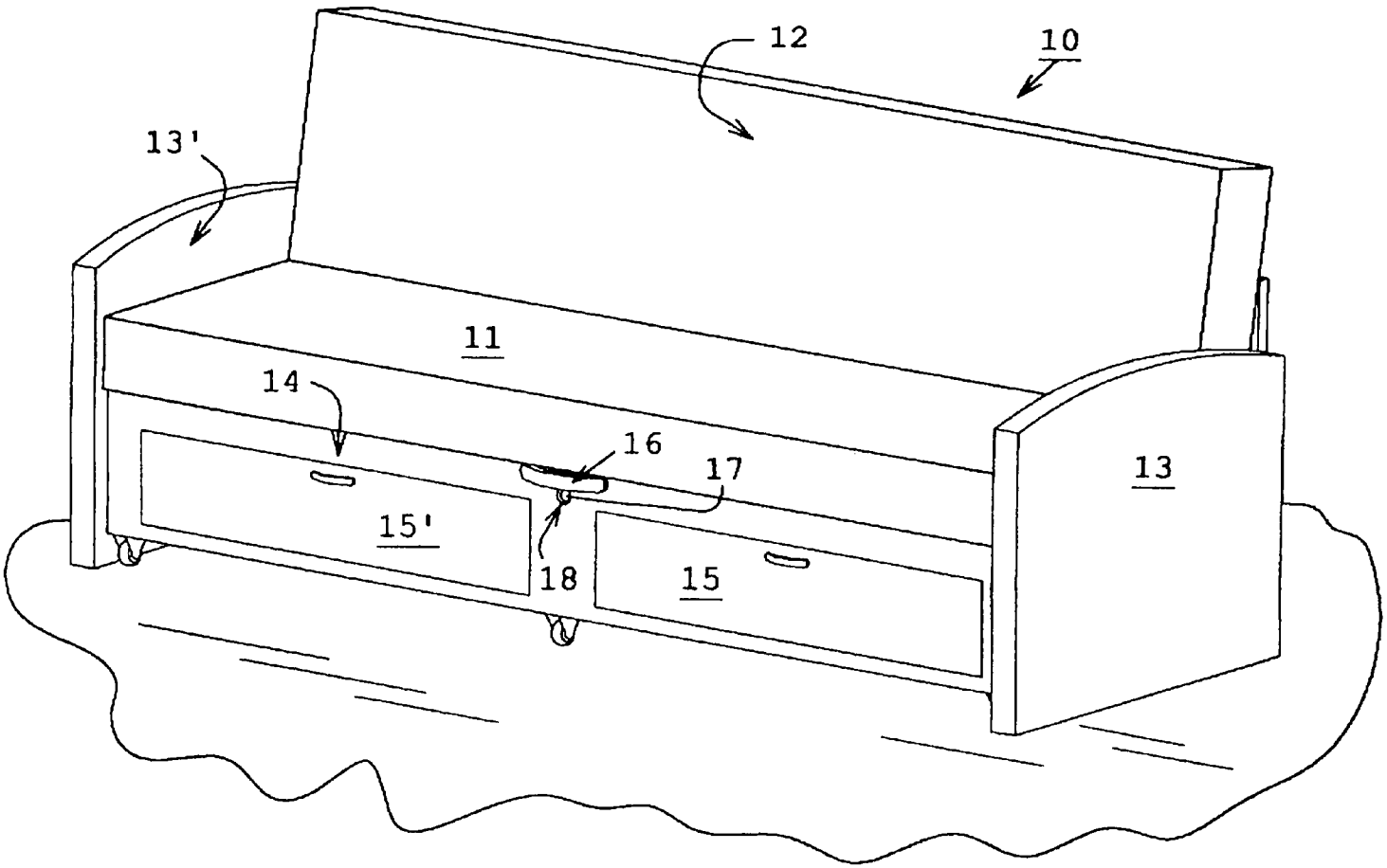
FIG. 1 shows a front perspective view of the preferred convertible furniture of the invention.

For a better understanding of the invention and its conversion method, turning now to the drawings, FIG. 1 shows preferred convertible furniture 10 in the form of a sofa having seat 11 and upright back 12 which is normal to seat 11. Furniture 10 also includes arm side panels 13, 13' and front panel 14 shown below seat 11 with drawers 15, 15' therein. While only two (2) drawers 15, 15' are shown in front panel 14 more or less drawers may be used depending on the particular manufacturer. Pull handle 16 is mounted on panel 14 with latch ball 17 conveniently exposed through front panel opening 18 therebelow.

Figure 2:
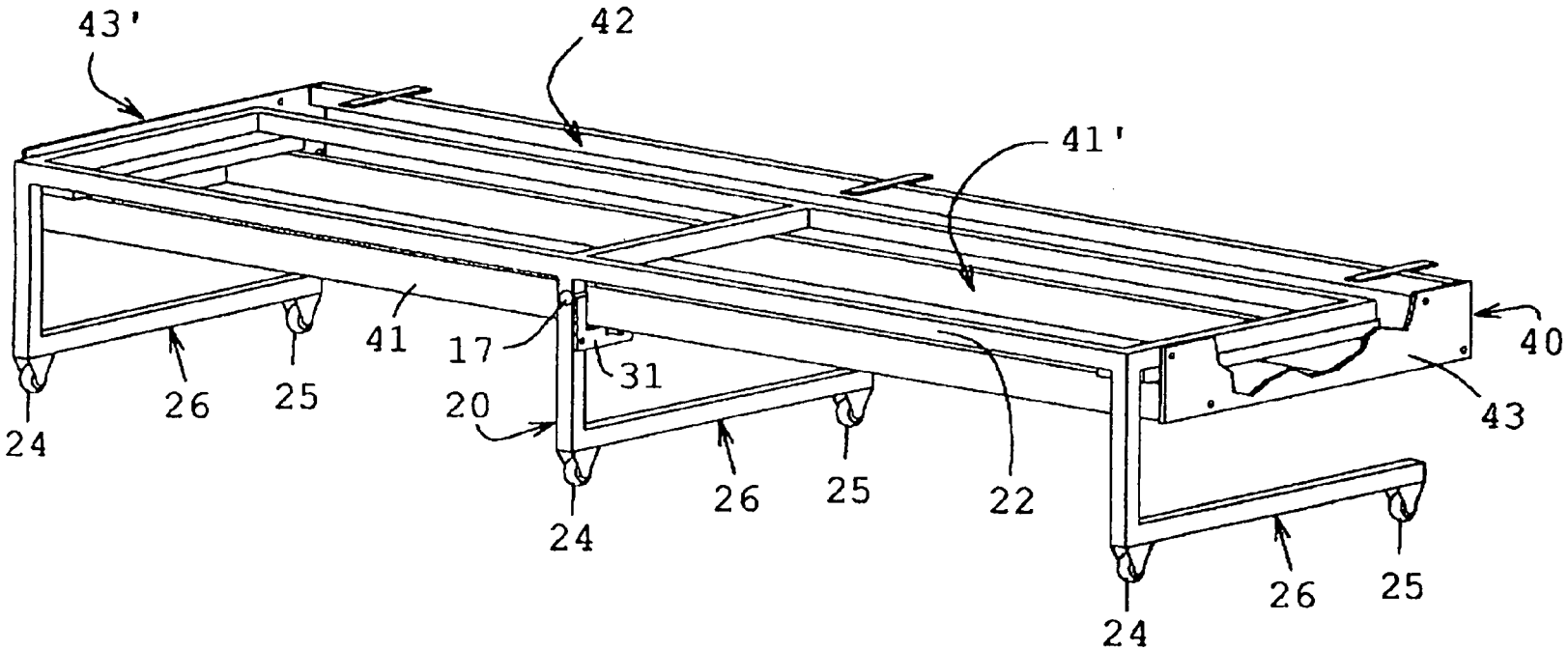
FIG. 2 depicts only the slide and slide support as removed from the furniture as shown in FIG. 1 in a closed or sofa configuration.
Figure 3:
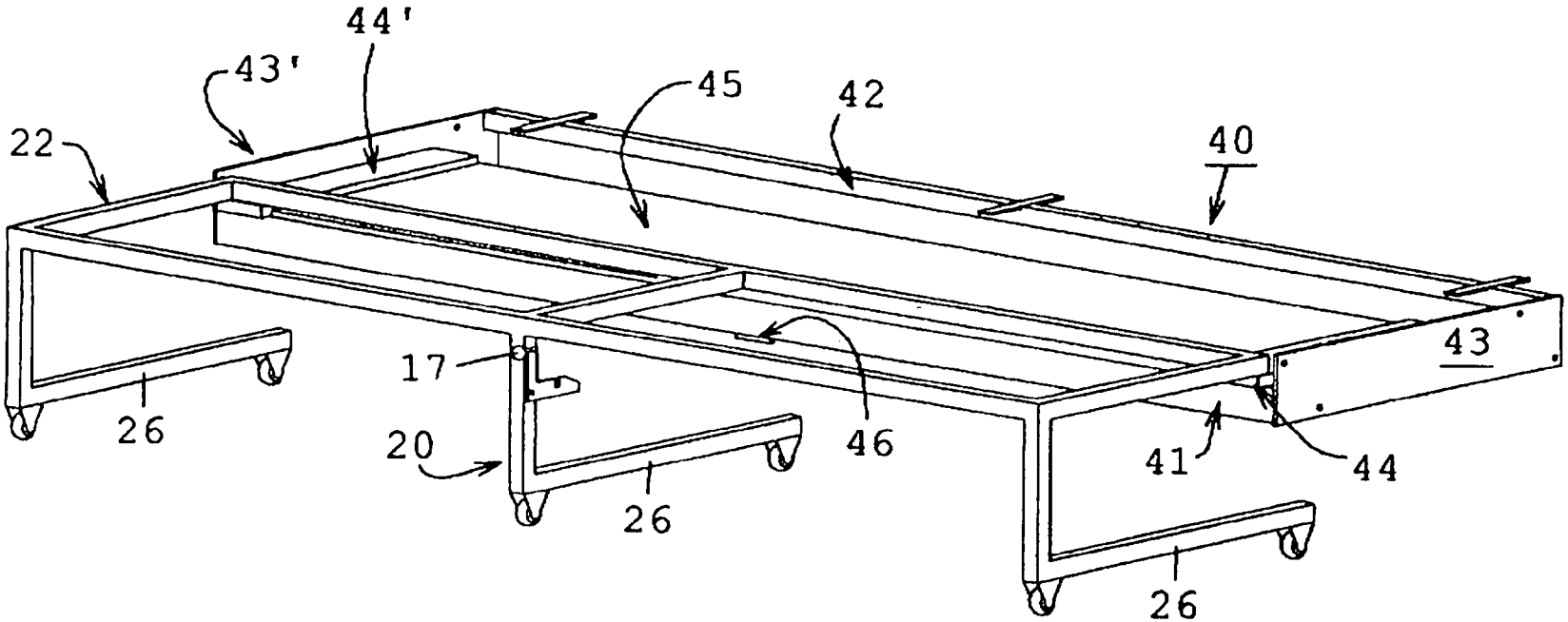
FIG. 3 illustrates the slide and slide support as shown in FIG. 2 in an open or bed form.

Furniture 10 further includes slide 20 and slide support 40 shown in FIGS. 2 and 3 removed from furniture 10. Slide 20 includes a rectangular metal upper section 22 with three (3) L-shaped legs 26 connected thereto as by welding or other means of attachment. Legs 26 include front casters 24 and rear casters 25 for ease in rolling.

Slide support 40 is also rectangular in shape and includes lower support members 41, 41', rear upper support member 42, side members 43, 43' and slide rails 44, 44' mounted atop lower support members 41, 41'. Slide support 40 is affixed between side panels 13, 13' such as by conventional nuts and bolts or screws (not shown). Rear panel 28 is likewise affixed to side panels 13, 13' for stability and to provide support for back 12 when in the sofa mode.

In FIG. 2, slide 20 and slide support 40 are shown in a closed or contracted posture (sofa mode) whereas in FIG. 3, slide 20 is shown extended (bed mode) from slide support 40. Slide 20 is formed from metal tubing having a rectangular cross-section and is preferably formed from steel tubing. Slide support 40 is preferably formed from metal or other suitable materials.

Figure 8:
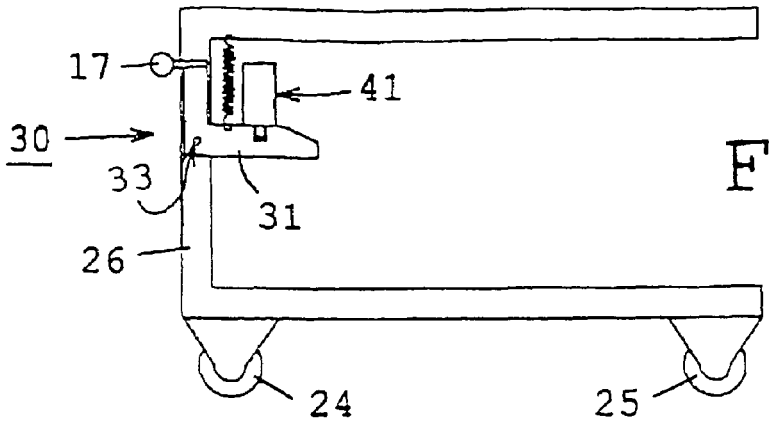
FIG. 8 shows a right side view of the furniture slide and latch mechanism as shown in FIG. 2.
Figure 9:
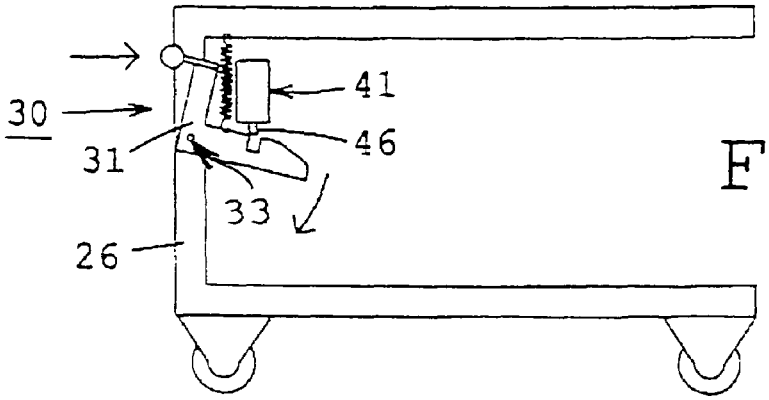
FIG. 9 depicts the slide as in FIG. 8 but with the latch mechanism open.
Figure 10:
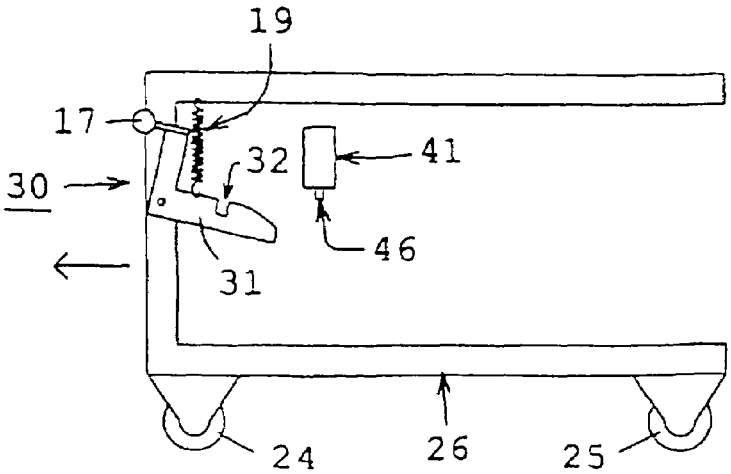
FIG. 10 demonstrates the latch open with the slide extending in a forward position as in FIG. 3.

Latch mechanism 30 shown slightly enlarged in FIGS. 8, 9 and 10 includes latch ball 17 affixed to L-shaped angle 31 having notch 32 therein for receiving lip 46 of lower support member 41 and further includes spring 19 for maintaining latch mechanism 30 in a closed posture such as when slide 20 and slide support 40 are in the sofa mode. Latch mechanism 30 is affixed to middle leg 26 of slide 20 by axle pin 33 (FIGS. 8, 9 and 10). When furniture 10 is closed (sofa mode) as seen in FIG. 8, notch 32 receives and maintains lip 46 (FIGS. 3, 9 and 10) of lower support member 41. When latch ball 17 is manipulated, L-shaped angle 31 is urged to pivot in a clockwise manner (FIGS. 8-10) to disengage lip 46 from notch 32, thereby releasing slide 20 from slide support 40 for conversion purposes. The rear edge of angle 31 is biased to assist in engaging lip 46.

Figure 4:
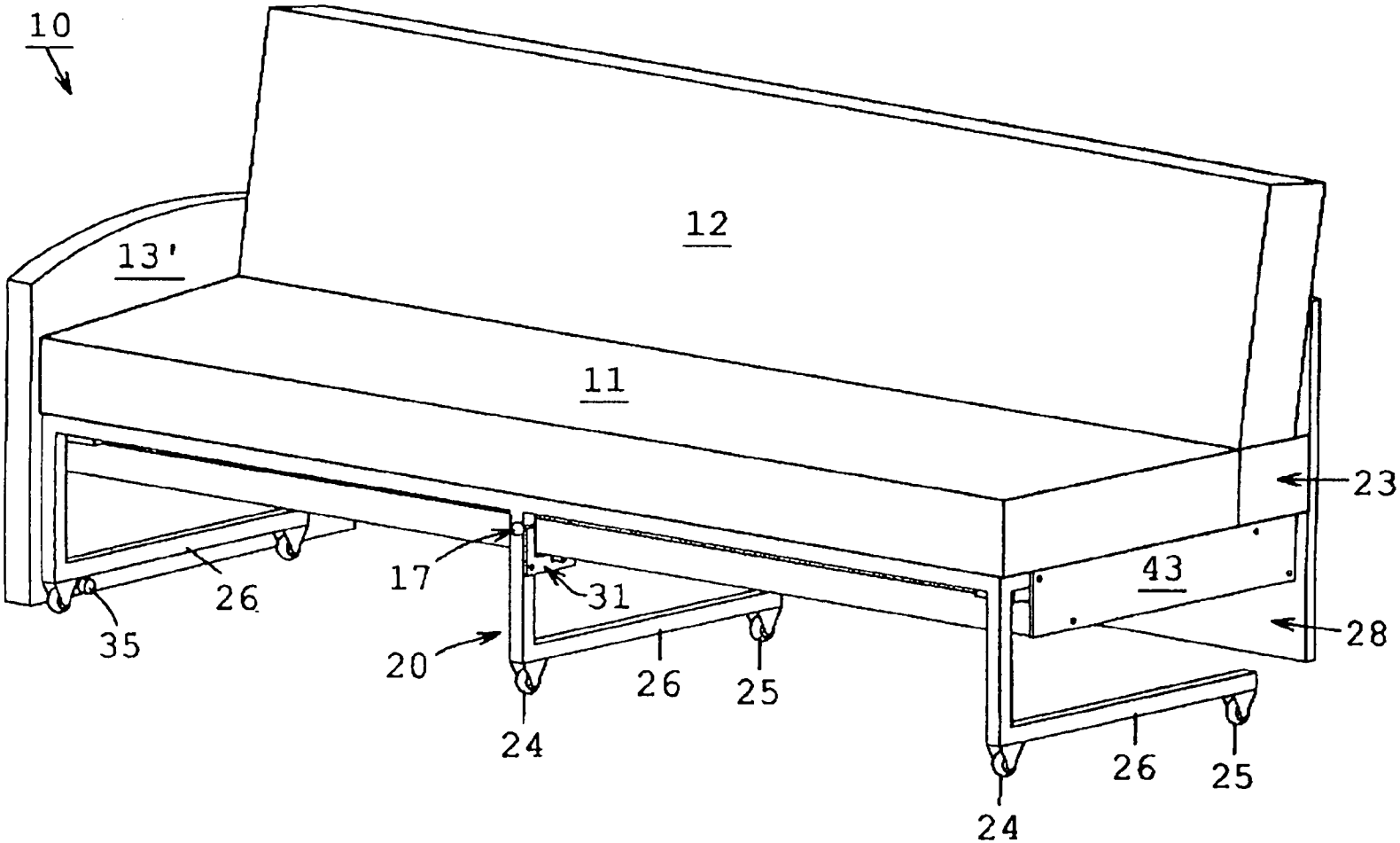
FIG. 4 demonstrates a view of the convertible furniture as shown in FIG. 1 but with the front and right arm panels removed.

The various phases of the preferred conversion method are shown in FIGS. 4, 5, 6 and 7 with right arm side panel 13 and front panel 14 removed for clarity purposes. In the preferred method as seen in FIG. 4, back 12 is in its normal upright position relative to seat 11 (sofa mode). Corresponding latch mechanism 30 shown in FIG. 8 is engaged holding slide 20 in a closed position relative to slide support 40.

Figure 5:
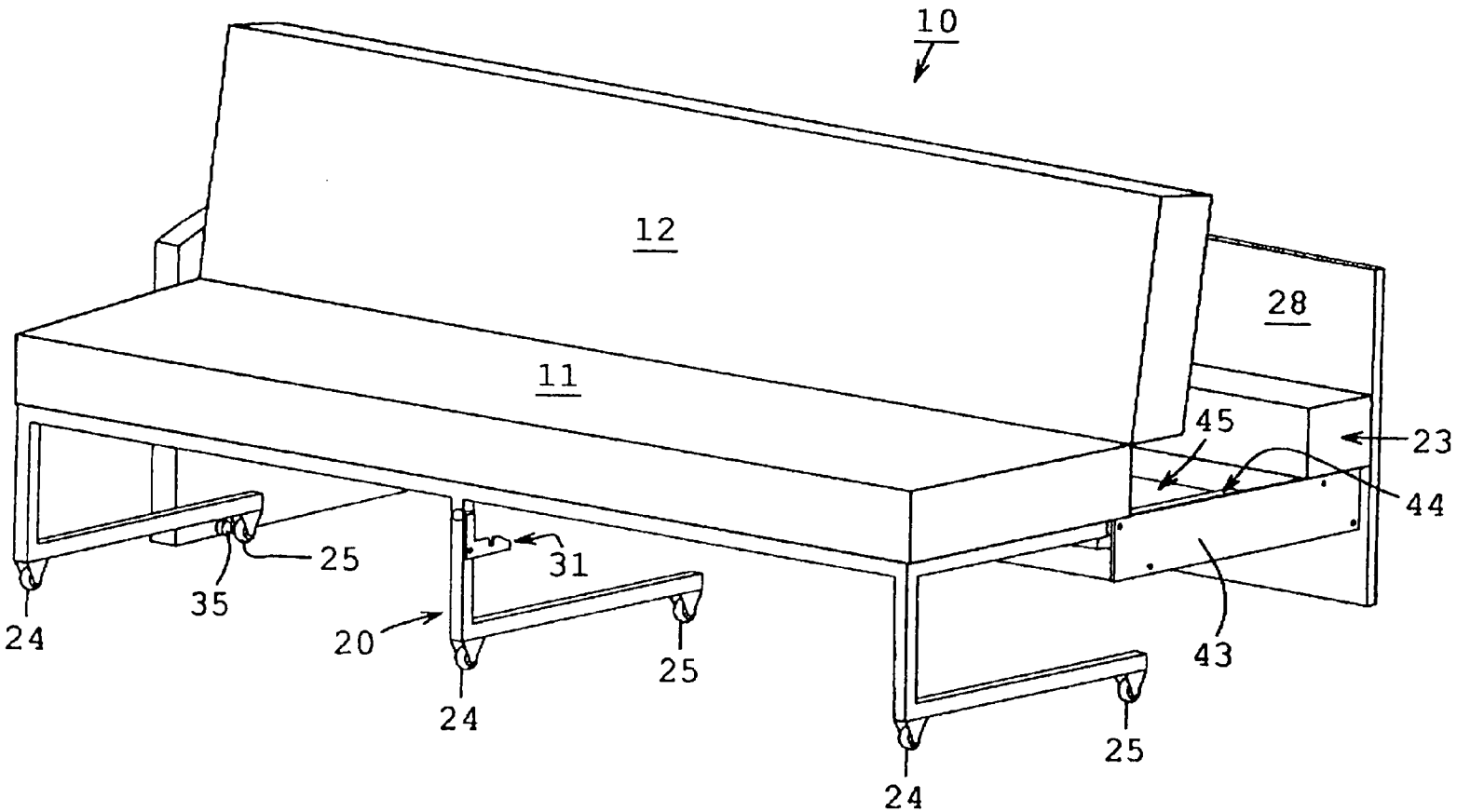
FIG. 5 features the convertible furniture as shown in FIG. 4 but with the slide forward of the slide support as seen in FIG. 3.
Figure 6:
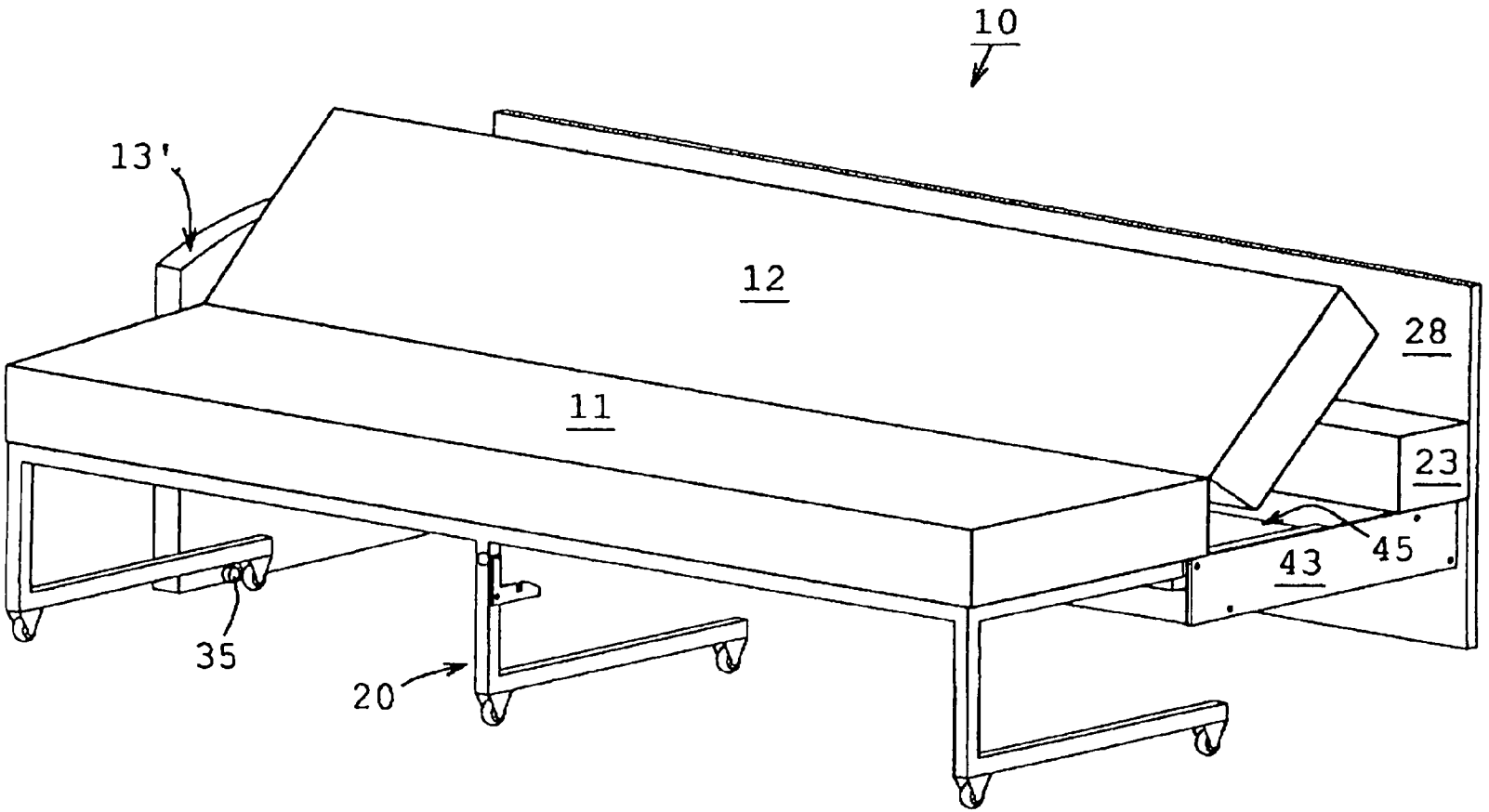
FIG. 6 illustrates the furniture of FIG. 5 with the back pivoted approximately 45 degrees as during its descent.

In FIG. 5, seat 11 is urged forwardly by pulling handle 16 with latch mechanism 30 released as in FIGS. 9 and 10. Back 12 has pivoted slightly rearwardly with seat extension 23 spaced from back 12 and seat 11. Seat 11, back 12 and seat extension 23 are formed as conventional in the trade, such as by using a selected quality fabric as cover for polyurethane foam cushioning of required density and size. Seat 11 and seat extension 23 both include a piece of plywood (not shown) affixed to the bottom thereof for added stability for connection to respectively slide 20 and rear support member 42 of slide support 40 by conventional screws (not shown). In FIG. 6 back 12 is sewn to the rear upper edge of seat 11 and has increasingly pivoted from its position as seen in FIG. 5 clockwise as it descends into a prone posture (FIG. 7) to rest on planar member 45 (FIGS. 3, 5 and 6) which is preferably formed from plywood or other rigid material. Stops 35, 35' (35 not shown) attached to, respectively arm side panels 13, 13' limit the motion of slide 20 as casters 24, 25 make contact with stop 35 during the conversion process.

Figure 7:
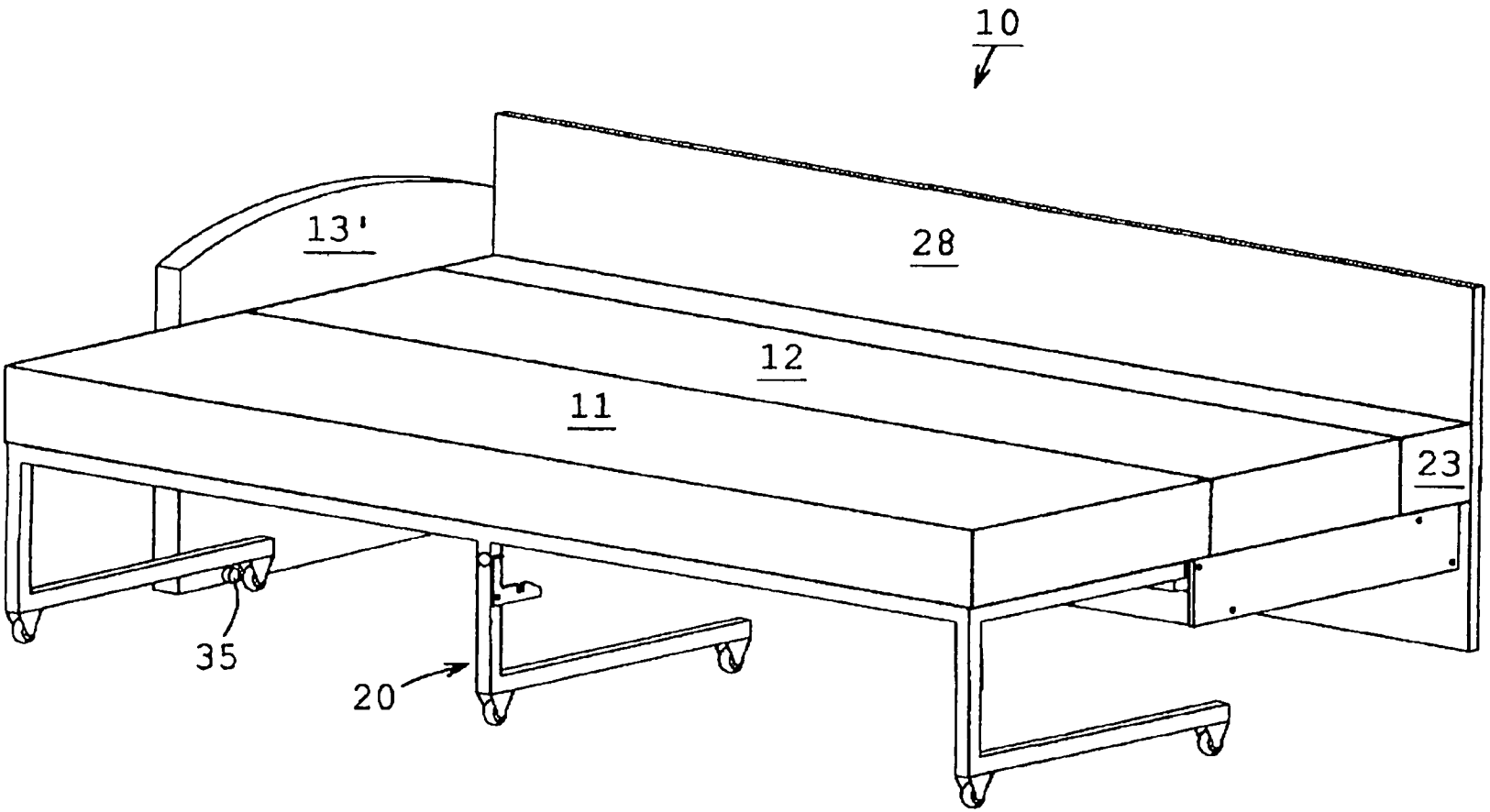
FIG. 7 pictures the furniture with the back in a fully downward posture as for the bed mode.

Slide 20 in FIG. 7 is now fully extended from seat 11 and back 12 has moved from its original normal, upright position as seen in FIG. 4 to a fully prone or horizontal position parallel with and between seat 11 and seat extension 23. Back 12, seat 11 and seat extension 23 now form a bed with an extra wide surface, approximately 51 inches (129.5 cm) in the preferred form shown. Rear panel 28 remains in a vertical posture as does front panel 14, (not shown in FIG. 7). Rear panel 28 remains in contact with seat extension 23. Rear panel 28 and front panel 14 are formed from wood and may be covered with fabric as is standard in the furniture industry.

The preferred conversion method shown in FIGS. 4-7 can be reversed to the sofa mode as seen in FIG. 4 by manually lifting back 12 and urging seat 11 positioned on slide 20 backward towards slide support 40 by pushing handle 16 on front panel 14 (FIG. 1) until angle 31 having notch 32 engages lip 46 of lower support member 41 as shown in FIG. 8. Arm side panels 13, 13' rest on the floor to stabilize convertible furniture 10 as slide 20 is rolled to and from slide support 40.

The illustrations and examples provided herein are for explanatory purposes and are not intended to limit the scope of the appended claims.

I claim:

1. Convertible furniture selectively functional either in a sleeper mode or a sofa mode comprising: a seat; a back; said seat pivotally joined to said back at the intersection formed by the top rear edge of the seat and the bottom front edge of the back when in the sofa mode; a seat extension, said seat extension positioned directly beneath said back and contacting said seat when in the sofa mode; a rear panel, said rear panel directly contacting said seat extension both in the sofa and sleeper modes, and directly contacting said back only in the sofa mode; a slide; a slide support, said slide support containing said slide, said slide horizontally, partially extendable from said slide support parallel thereto, said seat positioned on said slide, said seat extension positioned on said slide support whereby when in the sofa mode partially extending said slide from said slide support moves said seat from contact with said seat extension and allows said back to pivot for the sleeper mode from an upright position into horizontal alignment with and between said seat and said seat extension.

2. The convertible furniture of claim 1 further comprising a leg, said leg positioned on said slide.

3. The convertible furniture of claim 2 further comprises a wheel, said wheel affixed to said leg.

4. The convertible furniture of claim 1 wherein said slide support comprises an upper support member and a lower support member.

5. Furniture structure for conversion from a sofa to a sleeper comprising: a seat; a pivotable back; said pivotable back joined to said seat at the intersection formed by the top rear edge of the seat and the bottom front edge of the back when in the sofa mode, said back normal to said seat when said back is upright in the sofa mode; a seat extension, said seat extension positioned directly beneath said upright back; a slide, said seat affixed to said slide; a slide support, said slide contained within said slide support for horizontal parallel movement therealong; a rear panel, said rear panel attached to said slide support, said rear panel directly contacting said seat extension both in the sofa and sleeper modes, and directly contacting said back only in the sofa mode, said seat extension attached to said slide support whereby in the sleeper mode when said slide is partially extended from said slide support said back separates from said seat extension and said back is pivoted to a position between said seat and said seat extension.

6. The furniture structure of claim 5 further comprising a side panel, said side panel affixed to said slide support.

7. The furniture structure of claim 5 further comprising a leg, said leg connected to said slide.

8. The furniture structure of claim 7 further comprising a latch mechanism, said latch mechanism affixed to said leg, said latch mechanism for engaging said slide support to prevent movement thereof.

9. The furniture structure of claim 8 wherein said latch mechanism comprises a pivotable member, said pivotable member defining a notch, a lower support member, said lower support member affixed to said slide support, a lip, said lip affixed to said lower support member, said lip for engaging said notch to prevent movement of said slide support from said slide.

10. The furniture structure of claim 5 wherein said slide support comprises an upper support member and a lower support member.

* * * * *